United States Patent [19]

Roby et al.

[11] Patent Number: 4,606,430

[45] Date of Patent: Aug. 19, 1986

[54] RAIL MOUNTED SAFETY RESTRAINT DEVICE

[75] Inventors: William R. Roby, Powder Springs, Ga.; Charles M. Russell, Kernersville, N.C.

[73] Assignee: Southern Railway Company, Atlanta, Ga.

[21] Appl. No.: 784,047

[22] Filed: Oct. 4, 1985

[51] Int. Cl.[4] ..... A62B 35/00

[52] U.S. Cl. ..... 182/3; 182/36; 119/96; 248/214; 248/228

[58] Field of Search ..... 182/3, 4, 8, 9, 36; 119/96; 248/214, 228

[56] References Cited

U.S. PATENT DOCUMENTS

| | | | |
|---|---|---|---|
| 152,145 | 6/1874 | McGlashan . | |
| 828,409 | 8/1906 | Kazubek . | |
| 2,303,954 | 12/1942 | Roke | 182/3 |
| 3,137,487 | 6/1964 | Lesser | 182/3 |
| 3,217,833 | 11/1965 | Smith | 248/228 |
| 3,860,089 | 1/1975 | Huggett | 182/36 |
| 4,052,028 | 10/1977 | Cordero | 182/3 |
| 4,171,032 | 10/1979 | Woolslayer | 248/228 |
| 4,249,713 | 2/1981 | Glynn | 182/3 |
| 4,271,927 | 6/1981 | Brown | 182/36 |
| 4,407,392 | 10/1983 | Lazzari | 182/3 |

*Primary Examiner*—Reinaldo P. Machado

*Attorney, Agent, or Firm*—Watson, Cole, Grindle & Watson

[57] ABSTRACT

A safety restraint device is adapted to be mounted on a rail of a railway track, and includes a substantially U-shaped hood having a pair of hinged hood sections each supporting upper and lower rollers for engagement respectively with upper and lower surfaces of the ball of the rail. The upper rollers are adjustable for accommodating different rail weights, the rollers are located wholly within the hood, and the hinged hood sections permit quick assembly to and removal from the rail.

6 Claims, 4 Drawing Figures

RAIL MOUNTED SAFETY RESTRAINT DEVICE

BACKGROUND OF THE INVENTION

This invention relates generally to a safety restraint device adapted to be mounted on a rail of a railway track, and more particularly to such a device comprising a substantially U-shaped hood having a pair of hinged sections supporting upper and lower rail engageable rollers, the hood being assembled in place from opposite sides of the rail.

During construction or repair of a railroad bridge, the railroad bridge men must be provided safe and efficient working conditions without the danger of falling off the bridge. Safety nets could be provided although falling bridge structure parts would only tear the nets defeating the purpose of the safety net for the bridge men before the nets can be repaired. Moreover, stringing up the nets is dangerous in itself for the netting workmen.

A system of safety belts or safety harnesses with suitably long lanyards is probably the safest system for the railroad bridge men. However, this poses a problem in the manner of anchoring the lanyard. One approach would be for the bridge man to attach his lanyard around a rail or a bridge tie or a guard timber prior to each work location or operation. This, however, presents a problem in that the bridge man must unhook and rehook each time he moves. This is not only time consuming but offers no protection for the bridge men while moving from one location to the other.

One approach in avoiding some of these problems would be to secure a cable along the center of the track so that the workman could hook his lanyard thereto. This would provide the workman more mobility, except that installation of the cable is time consuming and would only interfere with the progress of the bridge work. Moreover, the cable would present a tripping hazard, and if one workman fell off the bridge it would likely pull the cable sufficiently to cause others to fall.

SUMMARY OF THE INVENTION

It is therefore an object of the present invention to avoid the recognized problems in attempts to protect the bridge men from the perils which could occur, while at the same time providing adequate protection in a manner which proves efficient, practical and less time consuming. Since the railway is usually left intact when the entire bridge is removed for reconstruction or repair, it has been found that the lanyard could be suitably attached to a device removably mounted on the rail for travel freely along the length of the rail. Thus, the rail provides a rigid anchor which remains immobile even if the workman falls. Also, no separate operations need be carried out such as by installing a safety net or a cable anchor. And, the rail presents no interference as does a cable during the work operation, and the workman is safely restrained as he moves from one work location to the other.

Another object of this invention is to provide such a safety restraint device which may be quickly and securely attached to the ball of the rail by hinging the device open and bolting it closed. The device includes a substantially U-shaped hood having a pair of hinged sections adapted for surrounding the ball of the rail, upper and lower rollers mounted on the sections for respectively engaging upper and lower surfaces of the rail ball to facilitate rolling movement of the hood along the rail, removable means extending between the hood sections for maintaining the rollers engageable with the rail ball, and means on one of the sections for anchoring a lanyard to the rail.

A further object of the present invention is to provide such a device in which the rollers are located wholly within the hood and are mounted on the side walls thereof.

A still further object is to provide such a device in which the upper rollers are adjustable relative to the rail ball for accommodating different rail weights.

A still further object of the invention is to provide such a device in which the side walls of the hood slope outwardly for supporting the lower rollers at predetermined angles relative to this lower surfaces of the rail ball.

Other objects, advantages and novel features of the invention will become more apparent from the following detailed description of the invention when taken in conjunction with the accompanying drawings.

DETAILED DESCRIPTION OF THE INVENTION

Figure 1:
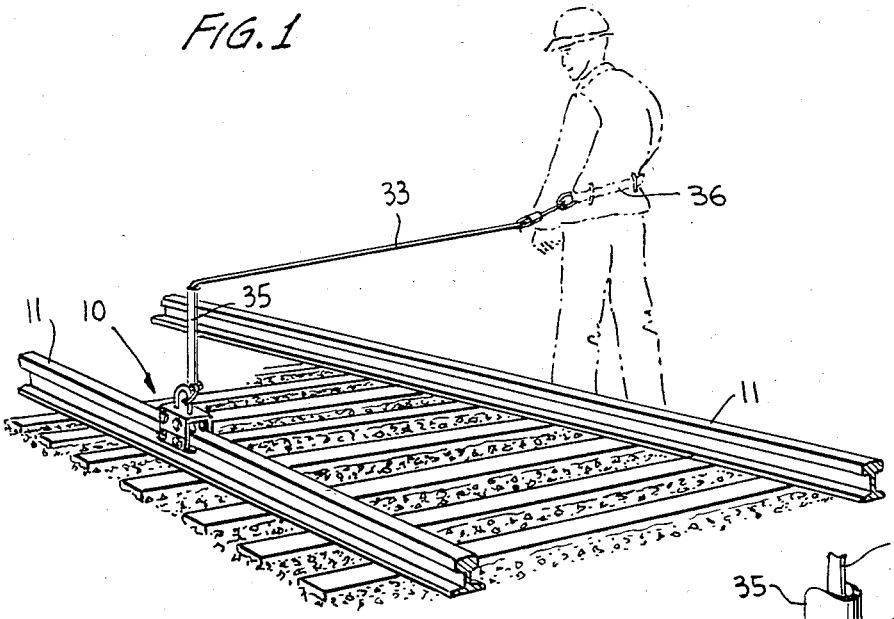
FIG. 1 is a prospective view of the device of the invention shown mounted on the rail of a railway track in use.
Figure 2:
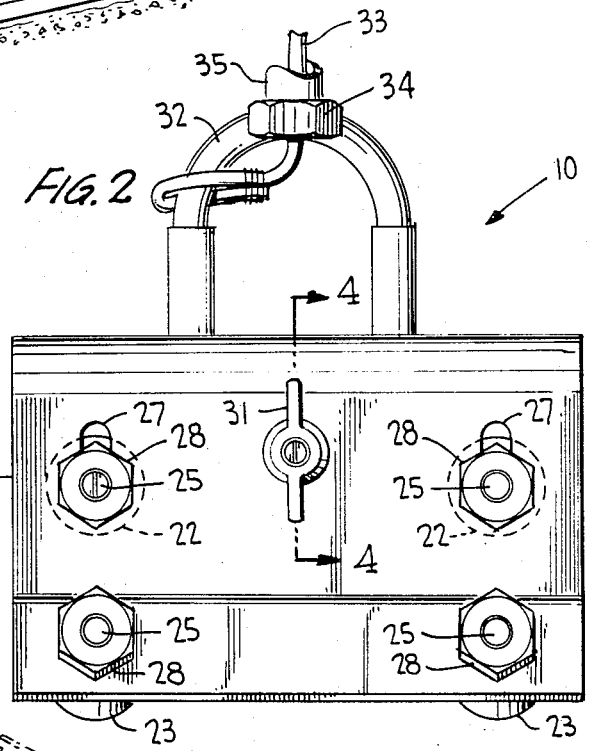
FIG. 2 is an enlarged side elevational view of the safety restraint device of the invention.
Figure 3:
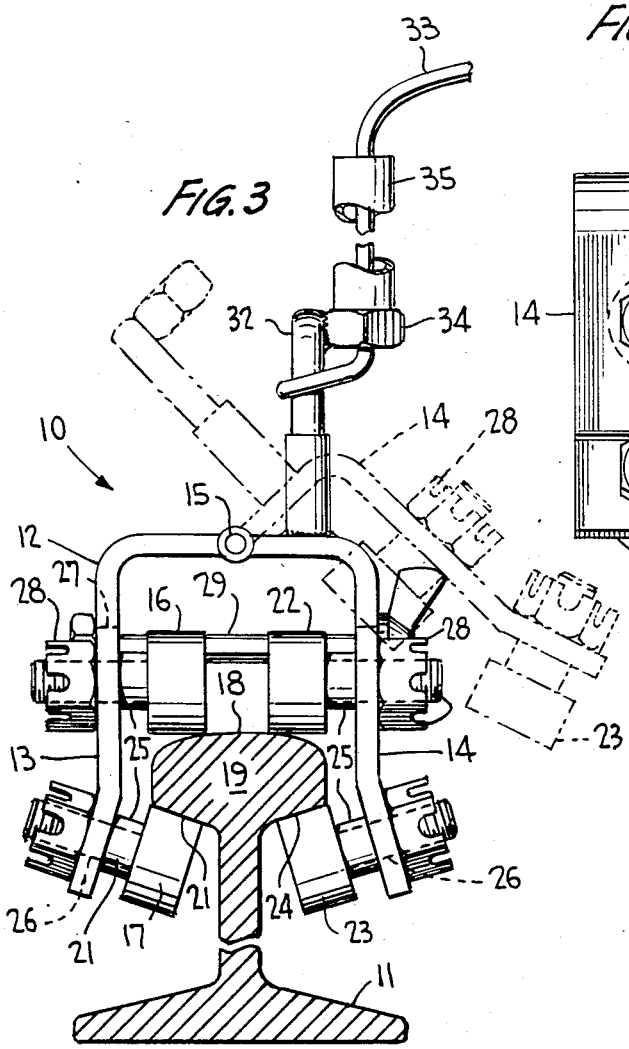
FIG. 3 is an end view of the device of FIG. 2 shown mounted in place on the rail ball.

Turning now to the drawings wherein like reference characters referred to like and corresponding parts throughout the several views, a safety restraint device generally designating 10 is shown in FIG. 1 mounted for rolling movement along either rail 11 of a railway track. As more clearly shown in FIGS. 2 and 3, the device comprises a substantially U-shaped hood 12 split into a pair of hood sections 13 and 14 hinged together at the base thereof as at 15. A first pair of upper and lower rollers 16 and 17 are mounted on hood section 13 respectively for rolling engagement with upper surface 18 of the ball 19 of the rail and with a lower surface 21 of the rail ball. Similarly, a second pair of upper and lower rollers 22 and 23 are mounted on hood section 14 for rolling engagement respectively with upper surface 18 of the rail ball and a lower surface 24 thereof. As seen more clearly in FIG. 2, there are a spaced apart pair of upper rollers 22 engageable with surface 18 of the rail ball and a spaced apart pair of lower rollers 23 engageable with lower surface 24 of the rail ball. Similarly, spaced apart pairs of upper and lower rollers 16 and 17 are mounted on hood section 12, although only one of each such rollers is shown in FIG. 3.

Each of the rollers has a roller shaft 25 on which the rollers are freely mounted, the shafts of the lower rollers extending through circular openings 26 of the hood sections and the shafts of the upper rollers extending through elongated opening 28 (See FIG. 2) to facilitate adjustment of the upper rollers relative to upper surface 18 of the rail ball to accommodate different weight rails from 80 lbs. to 136 lbs., for example.

The shafts may be externally threaded for engagement with fasteners such as nuts 28 for securing the upper and lower rollers in place.

Figure 4:
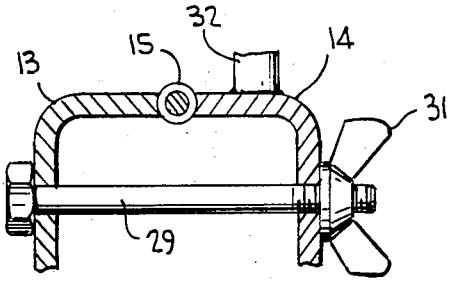
FIG. 4 is a cross-sectional view taken substantially along the line 4—4 of FIG. 2.

Means such as an elongated bolt 29 (FIGS. 3 and 4) extends between the hood sections parallel to the base of the hood, a wing nut 31 engaging the bolt serving to maintain the rollers in engagement with the upper and lower surfaces of the rail ball.

A clevis 32, or the like, is fixedly mounted on one of the hood sections for anchoring a lanyard 33 (FIG. 1) to the safety restraint device. A nut 34 is secured to the outer side of the clevis at the top for supporting an upstanding hollow and flexible tube 35. The lanyard extends through the tube and is clamped to the clevis, as shown in phantom outline in FIG. 3. The end of the lanyard opposite the clevis hook end is secured to a harness 36 (FIG. 1) strapped about the waist of a bridge workman, for example. Thus, the flexible tube maintains the lanyard elevated above the rail track to avoid interference with other workmen on or near the track. And, tube 35 will flex as the lanyard is tensioned by the workman secured to it.

As shown in phantom outline in FIG. 3, one or both hood sections 12, 13 can be pivoted away from the rail for removal of the safety restraint device therefrom upon removal of bolt 29 and its wing nut 31. Similarly, the device may be easily and quickly assembled over the rail ball by pivoting one or both hood sections into the solid outline positions shown in FIG. 3, after which the bolt 29 and its wing nut 31 are secured in place to the position shown in FIG. 4.

From the foregoing it can be seen that a simple yet highly efficient safety restraint device is provided for movement along the rail to different work locations without unhooking and rehooking the lanyard when changing work locations. The device is freely moveable along the rail and its rollers snugly embrace the rail ball to avoid any dislodging after being mounted in place. And, the device is structured so as to be easily and quickly installed on the rail and removed therefrom with little effort and without the need for any special tools.

Obviously, many modification and variations of the present invention are made possible in the light of the above teachings. It is therefore to be understood that within the scope of the appended claims the invention may be practiced otherwise than as specifically described.

What is claimed is:

1. A safety restraint device adapted to be mounted on a rail of a railway track, comprising a substantially U-shaped hood having a pair of hinged sections adapted for surrounding the ball of the rail, at least a first pair of upper and lower rollers mounted on one of said sections, and at least a second pair of upper and lower rollers mounted on the other of said sections, said upper and lower rollers respectively engaging upper and lower surfaces of the rail ball to facilitate rolling movement of said hood along the rail, removable means extending between said sections for maintaining said rollers engaeable with the rail ball, and means on one of said sections for anchoring a lanyard to the rail.

2. The device according to claim 1, wherin said first and second pairs of rollers are located wholly within said hood and are respectively mounted on sidewalls thereof.

3. The device according to claim 1, wherein said removable means comprise an elongated fastener.

4. The device according to claim 1, wherein said anchoring means comprises a clevis.

5. The device according to claim 2, wherein said rollers include roller shafts extending through openings provided in said side walls, said opening for said shafts of said upper rollers being elongated to facilitate adjustment of said upper rollers reltive to said lower rollers to accommodate various rail weights.

6. The device according to claim 2, wherein the free ends of said side walls slope outwardly for supporting said lower rollers at predetermined angles relative to the lower surfaces of the rail ball.

* * * * *